US010544524B2

(12) United States Patent
Liukkonen et al.

(10) Patent No.: US 10,544,524 B2
(45) Date of Patent: Jan. 28, 2020

(54) MECHANICAL METHOD AND SYSTEM FOR THE MANUFACTURE OF FIBROUS YARN AND FIBROUS YARN

(71) Applicant: Spinnova Oy, Vaajakoski (FI)

(72) Inventors: Johanna Liukkonen, Jyväskylä (FI); Sanna Haavisto, Jyväskylä (FI); Pasi Selenius, Lievestuore (FI); Juha Salmela, Laukaa (FI); Janne Poranen, Muurame (FI)

(73) Assignee: Spinnova Oy, Vaajakoski (FI)

( * ) Notice: Subject to any disclaimer, the term of this patent is extended or adjusted under 35 U.S.C. 154(b) by 0 days.

(21) Appl. No.: 15/569,102

(22) PCT Filed: Apr. 25, 2016

(86) PCT No.: PCT/FI2016/050268

§ 371 (c)(1),
(2) Date: Oct. 25, 2017

(87) PCT Pub. No.: WO2016/174306

PCT Pub. Date: Nov. 3, 2016

(65) Prior Publication Data

US 2018/0119315 A1 May 3, 2018

Related U.S. Application Data

(60) Provisional application No. 62/153,635, filed on Apr. 28, 2015.

(51) Int. Cl.

| | |
|---|---|
| ***D21F 11/16*** | (2006.01) |
| ***D02G 3/08*** | (2006.01) |
| ***D02G 3/04*** | (2006.01) |
| ***D21H 11/20*** | (2006.01) |

(52) U.S. Cl.
CPC ..... *D02G 3/08* (2013.01); *D02G 3/04* (2013.01); *D21F 11/16* (2013.01); *D21H 11/20* (2013.01)

(58) Field of Classification Search
USPC ..... 162/157.6
See application file for complete search history.

(56) References Cited

U.S. PATENT DOCUMENTS

| | | | | |
|---|---|---|---|---|
| 2,972,221 | A | 2/1961 | Werner Wilke et al. | |
| 3,423,925 | A | 1/1969 | George et al. | |
| 8,945,453 | B2 | 2/2015 | Kitagawa et al. | |
| 2014/0121622 | A1 | 5/2014 | Jackson et al. | |
| 2014/0331893 | A1* | 11/2014 | Salmela | D02G 3/02 106/162.1 |

FOREIGN PATENT DOCUMENTS

| | | | |
|---|---|---|---|
| DE | 326452 | C | 9/1920 |
| EP | 211607 | A3 | 2/1987 |
| JP | 2009173909 | A | 8/2009 |
| JP | 2010209510 | A | 9/2010 |
| JP | 2012087431 | A | 5/2012 |
| WO | 2009084566 | A1 | 7/2009 |
| WO | 2013034814 | A1 | 3/2013 |

OTHER PUBLICATIONS

DE-326542, Bruno Melzer, translation, Sep. 1920.*
Finnish Patent and Registration Office, Search report of PCT/FI2016/050268, dated Aug. 26, 2106.
Search report of EP16786018.8 issued by European Patent Office dated Apr. 1, 2019, 10 pages.

* cited by examiner

*Primary Examiner* — Mark Halpern
(74) *Attorney, Agent, or Firm* — Berggren LLP

(57) ABSTRACT

The invention relates to a method and system for manufacturing a fibrous yarn. An aqueous suspension having fibers and at least one rheology modifier is directed through at least one nozzle to form at least one fibrous yarn. The said nozzle is adapted to swirl the flow of the aqueous suspension around the main flow axis of the said nozzle. Then the aqueous suspension at the exit of the nozzle is merged with at least one annular flow comprising at least one cross linking reagent. Then the fibrous yarn is subjected to pressing mechanism. The pressing mechanism is adapted to dewater and twist the fibrous yarn. Finally, a fibrous yarn product having improved physical properties is produced.

9 Claims, 7 Drawing Sheets

MECHANICAL METHOD AND SYSTEM FOR THE MANUFACTURE OF FIBROUS YARN AND FIBROUS YARN

This is US national entry of international application number PCT/FI2016/050268 filed on Apr. 25, 2016 and claiming priority of U.S. provisional application No. 62/153,635, filed on Apr. 28, 2015, the contents of both of which are incorporated herein by reference.

FIELD OF THE DISCLOSURE

The invention relates to a method and a system for the manufacture of fibrous yarn, and particularly for the manufacture of paper yarn. Further, the invention relates to fibrous yarn obtainable by said method, as well as uses of said fibrous yarn.

BACKGROUND OF THE DISCLOSURE

Many different types of yarns made of natural fibers are known in the art. One well known example is paper yarn, which is traditionally manufactured from paper sheets. Typically, paper yarns are made from paper by first cutting the paper to narrow strips. These strips are then twisted to produce one paper yarn filament. These filaments are reeled to big reels and post processed to give different end properties. After this yarns are spun to smaller reels and finally dried in special drying unit.

The paper yarn has limited applications because of deficiencies in its properties, such as limited strength, unsuitable thickness, layered or folded structure, and further, the manufacturing method is inefficient.

In manufacturing paper yarn, the wet extrusion nozzle plays a key role in fiber orientation and in crosslinking of the fibers. However, to achieve the best possible yarn strength the fibers must be well twisted. Moreover, to improve the internal bonding of the fibers, the fibers must be bonded together. The previous known solutions provide a nozzle having a diameter smaller than average fiber length which provides an upper limit to achievable yarn diameter.

One such system and method has been disclosed in WO publication number WO 2013/034814 A1. Another document US granted Pat. No. 8,945,453 discloses method for producing polytetrafluoroethylene fiber and polytetrafluoroethylene fiber. These prior art documents discloses a nozzle structure adapted to produce yarn. However, the solutions disclosed in these prior arts do not provide for enhancing the strength of the natural fibrous yarn.

To achieve stronger natural yarn other alternatives than increasing the nozzle diameter must be found. Accordingly, there is a need for a system and a method that provides a fiber yarn having a higher yarn diameter along with a higher strength.

SUMMARY

Aspects of the invention are thus directed to a method and system for manufacturing a fibrous yarn. Initially an aqueous suspension having fibers and at least one rheology modifier is prepared. Thereafter, the said aqueous suspension is directed through at least one nozzle to form at least one yarn, and subjecting the said yarn to dewatering.

It is an object of the present invention to provide a method and system for manufacturing a fibrous yarn. The fibrous yarn so produced is pulled and twisted simultaneously while the aqueous suspension flows through at least one nozzle to form at least one fibrous yarn.

Aspects of the present invention may provide a method and system for manufacturing a fibrous yarn, wherein a cross-linking agent is added to the aqueous suspension at least before exiting of the aqueous suspension from at least one nozzle, or at least after the aqueous suspension exits from at least one nozzle.

Aspects of the present invention may provide a method and system for manufacturing a fibrous yarn, wherein, the aqueous suspension at the exit of the nozzle is merged with an annular flow of a cross linking reagent. An alternative to the annularly flowing cross-linking reagent can be also a stationary bath.

Aspects of the present invention may provide a method and system for manufacturing a fibrous yarn, wherein, a plurality of fibrous yarns is combined through a plurality of annular flow channels. The plurality of annular flow channels, as referenced herein, include an innermost flow channel, an outermost annular flow channel, and an annular flow channel sandwich between the innermost flow channel and the outermost annular flow channel. The innermost flow channel is adapted to accommodate the fiber suspension and the rheology modifier. The outermost annular flow channel is adapted to accommodate the cross linking reagent. The sandwiched annular flow channel is adapted to accommodate the cross linking agent.

Aspects of the present invention may provide a method and system for manufacturing a fibrous yarn, wherein, the fibrous yarn is pressed mechanically from at least two opposite sides by a plurality of plates floating on a deformable base. Alternatively or in combination with the said plates, all or some of the plates may be themselves deformable. Deformable plates are typically realized with a fluid bag, like a water bag or a pressurized air bag.

Aspects of the present invention may provide a method and system for manufacturing a fibrous yarn, wherein, the plurality of fibrous yarns is combined through coanda effect.

A method of manufacturing a fibrous yarn, the method includes:

- making an aqueous suspension having fibers and at least one rheology modifier;
- directing said aqueous suspension through at least one nozzle to form at least one fibrous yarn; and
- then subjecting said fibrous yarn to dewatering, characterized in that, the aqueous suspension inside the at least one nozzle is swirled around a main flow axis of the said nozzle.

A system for the manufacture of fibrous yarn, the system including:

- an aqueous suspension having fibers and at least one rheology modifier,
- at least one nozzle adapted to arrange a flow of the aqueous suspension into at least one fibrous yarn, and
- a dewatering arrangement adapted to dewater at least one fibrous yarn, characterized in that, the flow of the aqueous suspension is arranged to swirl around a main flow axis of at least one nozzle.

A fibrous yarn including:

- a dewatered aqueous suspension having fibers and at least one rheology modifier, wherein the aqueous suspension is swirled around the main flow axis of a nozzle and flows out from an exit point of the nozzle.

In an embodiment, the aqueous suspension is allowed to swirl around the main flow axis of the at least one nozzle by feeding the aqueous suspension to the at least one nozzle asymmetrically from the side of the said at least one nozzle.

In another embodiment, the aqueous suspension is allowed to swirl around the main flow axis of the at least one nozzle by creating, rotating and accelerating a flow of the aqueous suspension, where all the fibers are well aligned with the said flow by rotating around the main flow axis.

In yet another embodiment, the aqueous suspension is allowed to swirl around the main flow axis of the at least one nozzle by creating a swirling flow by using a plurality of grooved flow channels.

In yet another embodiment, the aqueous suspension is allowed to swirl around the main flow axis of the at least one nozzle by creating a swirling flow by using a plurality of bend flow channels. Bend flow channels may comprise ninety degree bend.

In addition and with reference to the aforementioned effect, embodiments of the invention comprise the aqueous suspension having fibers and at least one rheology modifier is allowed to swirl around the main flow axis of the nozzle. Such swirling of the aqueous suspension around the main flow axis of the nozzle is completed by feeding the aqueous suspension asymmetrically from the side of the nozzle. Further, a cross-linking agent is merged with the flow of the aqueous suspension at the exit of the nozzle. Furthermore, the aqueous suspension at the exit of the nozzle is pulled and twisted by gravity and then subjected to pressing and the dewatering.

Particularly, the ease of manufacture of the fibrous yarn, applicability of the yarn to various sites of use, possibility to design the properties of the yarn according to the intended use, small water footprint, biodegradability are some examples of the desired benefits achieved by embodiments of the present invention.

This together with the other aspects of the present invention along with the various features of novelty that characterized the present disclosure is pointed out with particularity in claims annexed hereto and forms a part of the present invention. For better understanding of the present disclosure, its operating advantages, and the specified objective attained by its uses, reference should be made to the accompanying descriptive matter in which there are illustrated exemplary embodiments of the present invention.

DESCRIPTION OF THE DRAWINGS

The embodiments and features of the present invention will become better understood with reference to the following detailed description taken in conjunction with the accompanying drawings, in which.

Like reference numerals refer to like parts throughout the description of several views of the drawing.

DESCRIPTION OF THE INVENTION

Figure 1B:
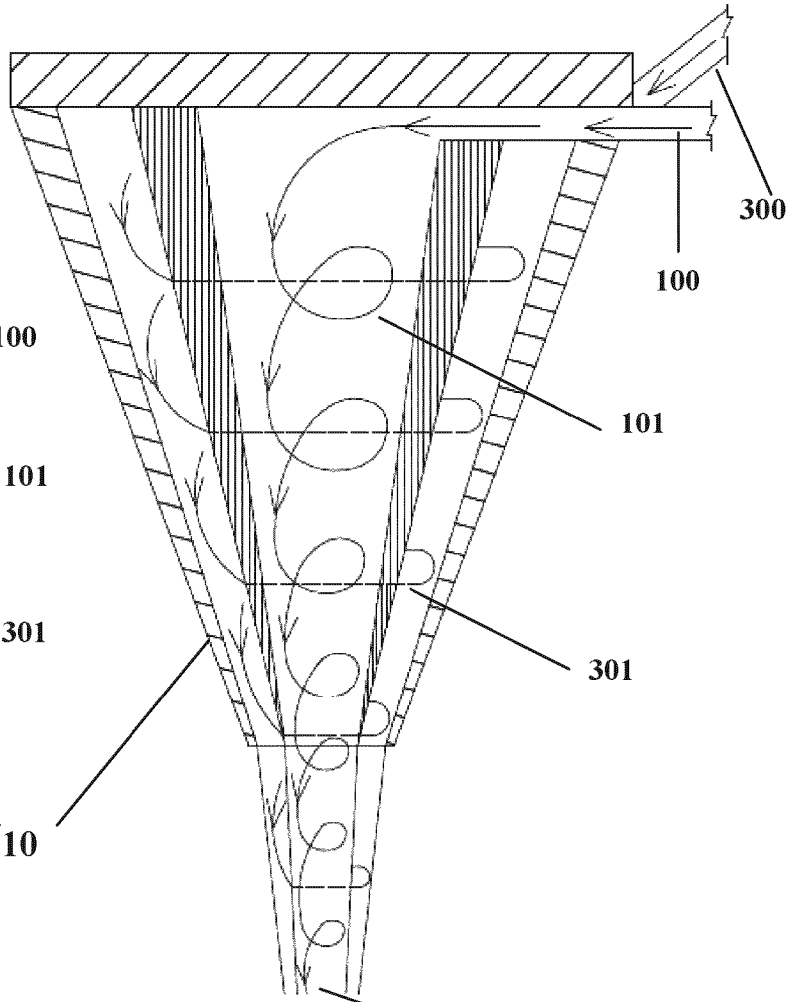
FIGS. 1(*a*)-1(*b*) illustrate an aqueous suspension swirling around a main flow axis of a nozzle, according to various embodiments of the present invention.

The embodiments described herein detail for illustrative purposes are subjected to many variations. It should be emphasized, however, that the present invention is not limited to method and system for producing fibrous yarn. It is understood that various omissions and substitutions of equivalents are contemplated as circumstances may suggest or render expedient, but these are intended to cover the application or implementation without departing from the spirit or scope of the present invention.

Unless otherwise specified, the terms, which are used in the specification and claims, have the meanings commonly used in the field of paper and pulp manufacture, as well as in the field of yarn manufacture. Specifically, the following terms have the meanings indicated below.

The terms "a" and "an" herein do not denote a limitation of quantity, but rather denote the presence of at least one of the referenced item.

The terms "having", "comprising", "including", and variations thereof signify the presence of a component.

The term "fiber" refers here to raw fibrous material either produced naturally or produced artificially.

The term "yarn" refers here to thread, yarn, chord, filament, wire, string, rope and strand.

The term "rheology modifier" is understood to mean here a compound or agent capable of modifying the viscosity, yield stress, and/or thixotropy of the suspension.

It should be note that the term "maximum length weighed fiber length of the fibers" as referenced hereinbelow means length weighted fiber length where 90 percent of fibers are shorter or equal to this length, wherein fiber length may be measured with any suitable method used in the art.

The term "crosslinking agent" is understood to mean here a compound or agent, such as a polymer, capable of crosslinking on fiber with itself in the suspension. This typically takes place in the water solution phase and leads to a gel.

The term "aqueous suspension" is understood to mean any suspension including water and fibers originating from any and at least one plant based raw material source, including cellulose pulp, refined pulp, waste paper pulp, peat, fruit pulp, or pulp from annual plants. The fibers may be isolated from any cellulose containing material using chemical, mechanical, thermo-mechanical, or chemi-thermo-mechanical pulping processes.

Further, the plant based raw material source may be a virgin source or recycled source or any combination thereof. It may be wood or non-wood material. The wood may be softwood tree such as spruce, pine, fir, larch, douglas-fir or hemlock, or hardwood tree such as birch, aspen, poplar, alder, eucalyptus or acacia, or a mixture of softwoods and hardwoods. The non-wood material may be plant, such as straw, leaves, bark, seeds, hulls, flowers, vegetables or fruits from corn, cotton, wheat, oat, rye, barley, rice, flax, hemp, manilla hemp, sisal hemp, jute, ramie, kenaf, bagasse, bamboo, reed or peat.

Suitably virgin fibers originating from pine may also be used. Said fibers typically may have average length weighed fiber length from 2 to 3 millimeters. Also combinations of longer fibers with shorter ones may be used, for example fibers from pine with fibers from eucalyptus.

The term "microfibrillated cellulose" and/or "nanofibrillar cellulose" or "nanofibrillated cellulose" as used hereinafter refer to a collection of isolated cellulose microfibrils or microfibril bundles derived from cellulose raw material. Microfibrils have typically high aspect ratio: the length might exceed one micrometer while the number-average diameter is typically below 200 nm. The diameter of microfibril bundles may also be larger but generally less than 1 μιη. The smallest microfibrils are similar to so called elementary fibrils, which are typically 2-12 nm in diameter. The dimensions of the fibrils or fibril bundles are dependent on raw material and disintegration method.

The nanofibrillar cellulose may also contain some hemicelluloses; the amount is dependent on the plant source. Mechanical disintegration of microfibrillar cellulose from cellulose raw material, cellulose pulp, or refined pulp is carried out with suitable equipment such as a refiner, grinder, homogenizer, colloider, friction grinder, ultrasound sonicator, fluidizer such as microfluidizer, macrofluidizer or fluidizer-type homogenizer. In this case, the nanofibrillar cellulose is obtained through disintegration of plant cellulose material and may be called "nanofibrillated cellulose".

"Nanofibrillar cellulose" may also be directly isolated from certain fermentation processes. The cellulose-producing microorganism of the present invention may be of the genus *Acetobacter, Agrobacterium, Rhizobium, Pseudomonas or Alcaligenes*, preferably of the genus *Acetobacter* and more preferably of the species *Acetobacter xylinum* or *Acetobacter pasteurianus*.

"Nanofibrillar cellulose" may also be any chemically or physically modified derivate of cellulose nanofibrils or nanofibril bundles. The chemical modification could be based for example on carboxymethylation, oxidation, esterification, or etherification reaction of cellulose molecules. Modification may also be realized by physical adsorption of anionic, cationic, or non-ionic substances or any combination of these on cellulose surface. The described modification may be carried out before, after, or during the production of microfibrillar cellulose.

The nanofibrillated cellulose may be made of cellulose which is chemically premodified to make it more labile. The starting material of this kind of nanofibrillated cellulose is labile cellulose pulp or cellulose raw material, which results from certain modifications of cellulose raw material or cellulose pulp. For example, N-oxyl mediated oxidation (e.g. 2,2,6,6-tetramethyl-l-piperidine N-oxide) leads to very labile cellulose material, which is easy to disintegrate to microfibrillar cellulose. For example patent applications WO 09/084566 and JP 20070340371 disclose such modifications. The nanofibrillated cellulose manufactures through this kind of premodification or "labilization" is called "NFC-L" for short, in contrast to nanofibrillated cellulose which is made of not labilized or "normal" cellulose, NFC-N.

The nanofibrillated cellulose is preferably made of plant material where the nanofibrils may be obtained from secondary cell walls. One abundant source is wood fibers. The nanofobrillated cellulose is manufactured by homogenizing wood-derived fibrous raw material, which may be chemical pulp. When NFC-L is manufactured from wood fibers, the cellulose is labilized by oxidation before the disintegration to nanofibrils. The disintegration in some of the above-mentioned equipment produces nanofibrils which have the diameter of only some nanometers, which is 50 nm at the most and gives a clear dispersion in water. The nanofibrils may be reduced to size where the diameter of most of the fibrils is in the range of only 2-20 nm only. The fibrils originating in secondary cell walls are essentially crystalline with degree of crystallinity of at least 55%.

FIGS. 1-7 describe arrangement of various and components of the present invention in conjugation of the method and system for manufacturing the fibrous yarn of the present invention.

Figure 1A:
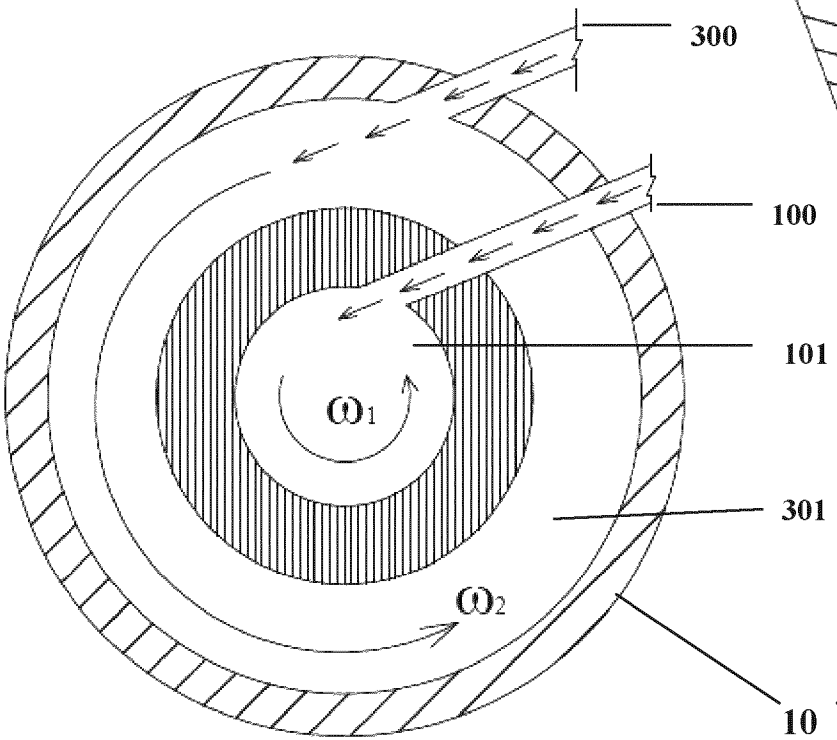

In FIGS. 1(*a*) and 1(*b*), an implementable embodiment for the working of the nozzle according to the invention is presented. FIG. 1(*a*) shows the top view of the nozzle (10) and FIG. 1(*b*) shows the side view of the nozzle (10.

In various embodiments of the present invention, it was surprisingly found that fibrous yarn may be manufactured in a very simple and efficient way directly from a suspension, whereby it was not necessary to manufacture first paper or other fibrous product, which is sliced into strips and wound to a yarn.

It will be understood by the person skilled in the art that in the process for manufacturing of fibrous yarn, a suspension is usually directed through a nozzle and thereafter the fibrous yarn is dewatered to obtain the fibrous yarn. One way of manufacturing has been disclosed in WO publication number WO 2013/034814 A1. Suitably the amount of nozzles required in the system is selected depending upon the manufacturing equipment used and on the product which is manufactured.

Usually, any nozzle or extruder suitable for liquids and viscous fluids may be used in such system. When the suspension contains alginates, pectin or carrageenan, suitably a nozzle is used including an inner die or orifice for the suspension and outer die or orifice for an aqueous solution comprising at least one cation (as a salt, such as calcium chloride or magnesium sulphite). Alternatively, the solution comprising the cation (salt) may be provided as a spray or mist when using nozzles with one orifice. The cation, when brought in contact, for example, with alginate or alginic acid, it gives very rapid increase on the viscosity of the aqueous suspension whereby the strength of the yarn is increased, making the embodiment of the method utilizing the gravitational force very attractive.

Moreover, the inner diameter of the outlet of the nozzle is kept smaller than or equal to the maximum length weighed fiber length of the fibers. This helps to orientate the fibers essentially in the direction of the yarn and provides strength and flexibility to the product.

Now referring to FIG. 1(*a*) and FIG. 1(*b*), during the working of the nozzle (10), the aqueous suspension (100) having fibers and at least one rheology modifier is directed from the side of the nozzle (10) into the innermost flow channel (101) of the nozzle (10). Because of the design of the nozzle (10), the aqueous suspension (100) is allowed to swirl around (as shown) in the main flow axis of the nozzle (10) at an angular velocity $\omega_1$. The swirling of the aqueous suspension (100) is helpful for arranging and twisting the fibers of the aqueous suspension (100).

In various embodiments of the present invention, the aqueous suspension (100) is allowed to swirl around a main flow axis of the nozzle (10). In a preferred embodiment, the aqueous suspension (100) is allowed to swirl around the main flow axis of the nozzle (10) by feeding the aqueous suspension asymmetrically from the side of the said nozzle (10) as shown in FIG. 1(*a*) and FIG. 1(*b*).

In yet another embodiment, the nozzle (10) is designed such that aqueous suspension (100) is allowed to swirl around the main flow axis of the nozzle (10) by creating, rotating and accelerating a flow of the aqueous suspension (100). Where all the fibers are well aligned with the said flow of the aqueous suspension (100) by rotating around the main flow axis of the nozzle (10).

In yet another embodiment, the nozzle (10) is designed such that aqueous suspension (100) is allowed to swirl around the main flow axis of the nozzle (10) by creating a swirling flow through a plurality of grooved flow channels.

In yet another embodiment, the aqueous suspension (100) is allowed to swirl around the main flow axis of the nozzle (10) by creating a swirling flow by a plurality of ninety degree bend flow channels.

Further, FIG. 1(*a*) and FIG. 1(*b*) shows that the cross-linking agent (300) is directed from the side of the nozzle (10) into the outermost annular flow channel (301) of the nozzle (10). The crosslinking agent (100) also flows inside the outermost annular flow channel (301) at an angular velocity $\omega_2$. Accordingly, when the aqueous suspension (100) comes out from the exit (50) of the nozzle (10), the crosslinking reagent (300) is merged with the aqueous suspension (100). Accordingly, the fibrous hydrogel yarn at the exit (50) of the nozzle (10) is produced. The cross-linking assists in providing the yarn initial strength. The fibrous gel yarn is thereafter subjected to twisting and dewatering mechanism as explained later.

It should be noted that any features, steps, phases or parts of embodiments as hereinabove disclosed can be freely permuted and combined with each other in a combination of two or more embodiments in accordance with the invention.

Figure 2:
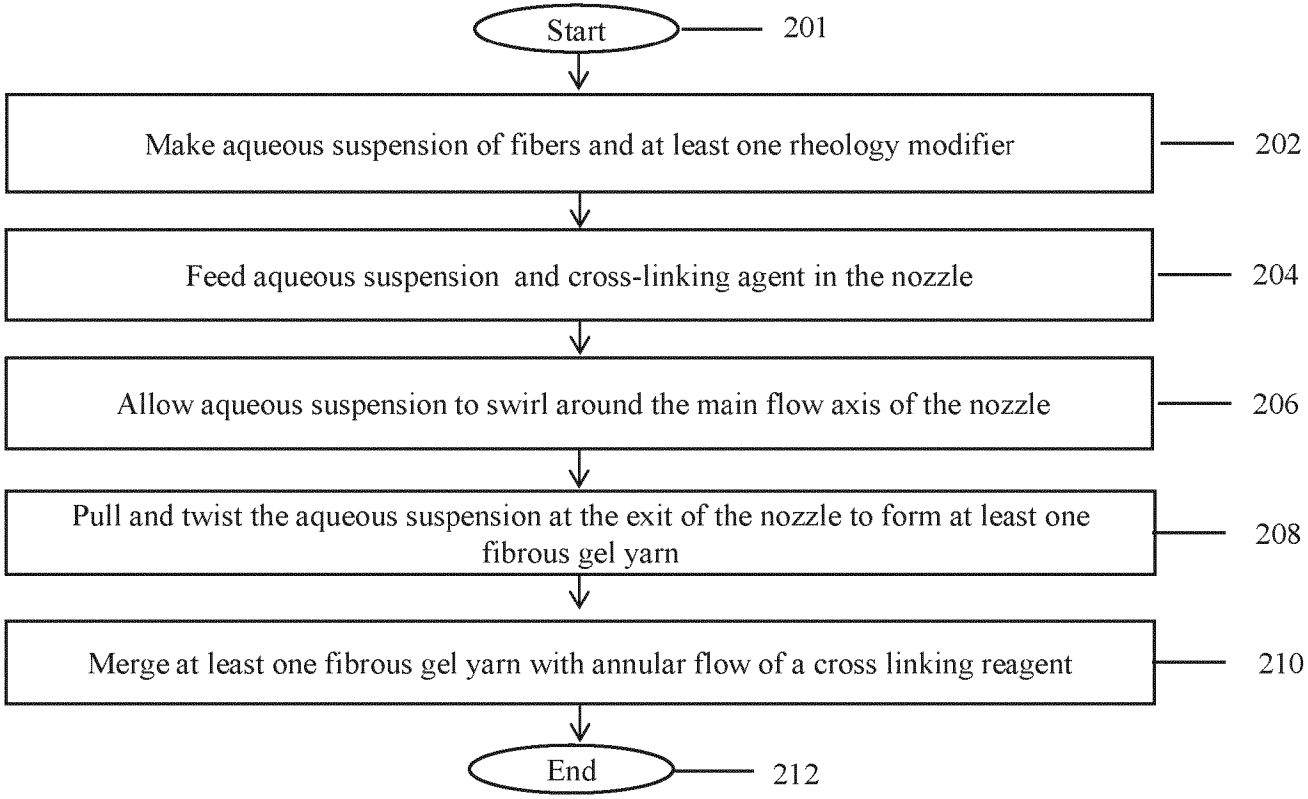
FIG. 2 illustrates a flow chart depicting various steps related to the method for producing the fibrous yarn, according to various embodiments of the present invention.

FIG. 2 is a flow chart depicting various steps related to the method for producing the fibrous yarn, according to various embodiments of the present disclosure. As shown in the flow chart, the method starts at step 201. At step 202, the aqueous suspension having fibers and at least one rheology modifier is prepared, thereafter, the aqueous suspension and the crosslinking agent is fed in the nozzle, such as the nozzle (10), at step 204. In this implementation, the aqueous suspension may be fed from the side of the nozzle (10), at step 204.

Then at step 206, the feeding of the aqueous suspension from the side of the nozzle (10) creates a swirl mechanism around the main flow axis of the nozzle (10). In some embodiments the gravitational pull is used at least somewhat to make the aqueous suspension come out from the exit of the nozzle (10) in form of fibrous gel yarn. However, fluid pressure is typically the driving force that is used to eject the fibrous gel yarn from the nozzle. Further, also a wire can be used to pull the hydrogel yarn from the nozzle, wherein the speed differential between the gel yarn and the wire is sometimes used to induce the exit of the gel yarn from the nozzle. Thereafter, at the exit of the nozzle, the at least one fibrous suspension gel yarn is merged with the annular flow of a cross-linking reagent, and hydrogel is produced through cross-linking at step 208. Accordingly, the fibrous hydrogel yarn comes out from the exit of the nozzle, at step 210. The yarn is thereafter pulled, twisted and dewatered in the dewatering section and dried in the drying section. The method ends at 212.

Accordingly, the final yarn product thus produced by the above method possesses improved yarn strength, stretch and smoothness. The swirling of the aqueous suspension around the main flow axis of the nozzle and treating the suspension with a cross linking reagent as well as a cross linking agent through the plurality of annular flow channels produces a fibrous yarn having improved strength, stretch and smoothness.

Figure 3:
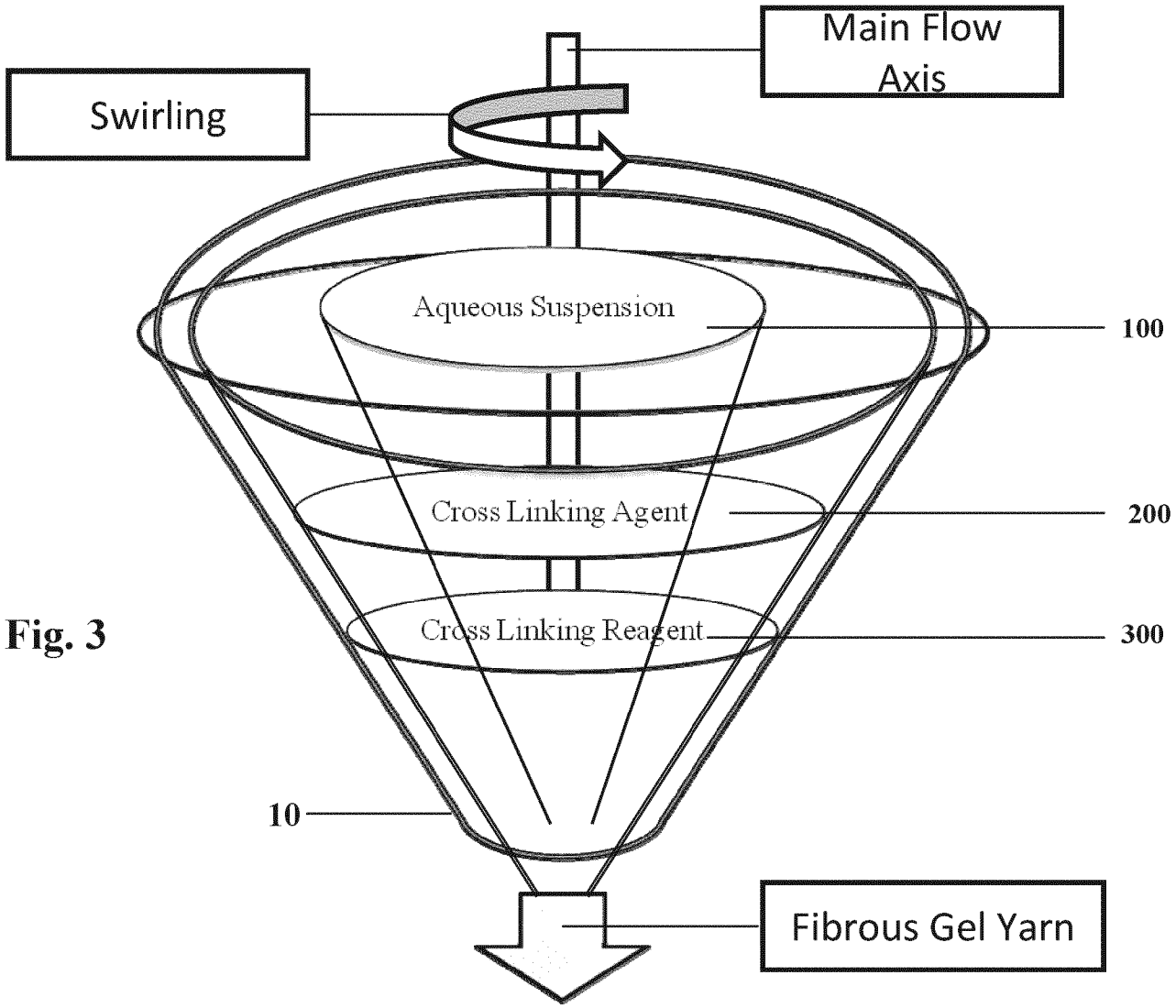
FIG. 3 illustrates a block diagram of a nozzle implemented for producing the fibrous yarn, according to various embodiments of the present invention.

FIG. 3 is a block diagram of a nozzle, such as nozzle (10), implemented for producing the fibrous yarn. The nozzle (10) includes innermost flow channel, an outermost annular flow channel, and an annular flow channel sandwich between the innermost flow channel and the outermost annular flow channel. The innermost flow channel is adapted to accommodate the aqueous suspension having fiber suspension and the rheology modifier. The outermost annular flow channel is adapted to accommodate the cross linking reagent. The sandwich annular flow channel is adapted to accommodate the cross linking agent. When the aqueous suspension swirls around the main flow axis of the nozzle (10) then all the fibers are arranged and twisted to the fibrous yarn having improved structural properties. At the exit of the nozzle, the aqueous suspension is merged with the cross linking reagent and the cross linking agent to form the fibrous yarn hydrogel.

The aqueous suspension (100) may comprise from 0.1 to 10 percent (%) weight/weight (w/w), preferably from 0.2 to 2% w/w of fibers originating from any plant based raw material source.

Additionally, the aqueous suspension (100) may optionally comprise virgin or recycled fibers originating from synthetic materials, such as glass fibers, polymeric fibers, metal fibers, or from natural materials, such as wool fibers, or silk fibers.

Preferably, the aqueous suspension (100) may include at least one rheology modifier that forms a gel by crosslinking the suspension, suitably selected from alginic acid, alginates such as sodium alginate, pectin, carrageenan, and nanofibrillar cellulose (NFC), or a combination of rheology modifiers. Said rheology modifier may be used in an amount from 0.1 to 20 weight %. Concentration of the rheology modifier, such as alginate is preferably 0.5 -20% w/w.

In the presence of cations, particularly divalent or multivalent cations, suitably such as Ca2+, Al2+, Na2+, Mg2+, Sr2+or Ba2+, alginate, pectin and carrageenan (carrageenan cross-links also with K+) readily form a stable and strong gel. In the cross-linking of these polysaccharides, calcium chloride is preferably used. The concentration of salt solution may vary from 1% w/w to 10% w/w.

Typically the poly-L-guluronic acid (G-block) content of alginate, poly-D-galacturonic acid content of pectin or carrageenan and the amount of divalent or multivalent cations (calcium ions) are regarded as being involved in determining gel strength.

The aqueous suspension (100) of the present invention may also include at least one dispersion agent that is typically anionic long chained polymer or NFC, or a combination of dispersion agents. Examples of suitable dispersion agents are carboxymethyl cellulose (CMC), starch (anionic or neutral) and anionic polyacrylamides (APAM), having high molecular weight. Dispersion agent modifies the suspension rheology to make the suspension shear thinning. Preferably at high shear rates (500 1/s) shear viscosity is less than 10% of zero shear viscosity of the suspension.

Said dispersion agent may be used in an amount from 0.1 to 20 weight %.

Optionally, the aqueous suspension (100) may be in the form of a foam, and in that case the suspension comprises at least one surfactant selected from anionic surfactants and non-ionic surfactants and any combinations thereof, typically in an amount from 0.001 to 1% w/w.

The aqueous suspension is obtained using any suitable mixing method known in the art.

Figure 4:
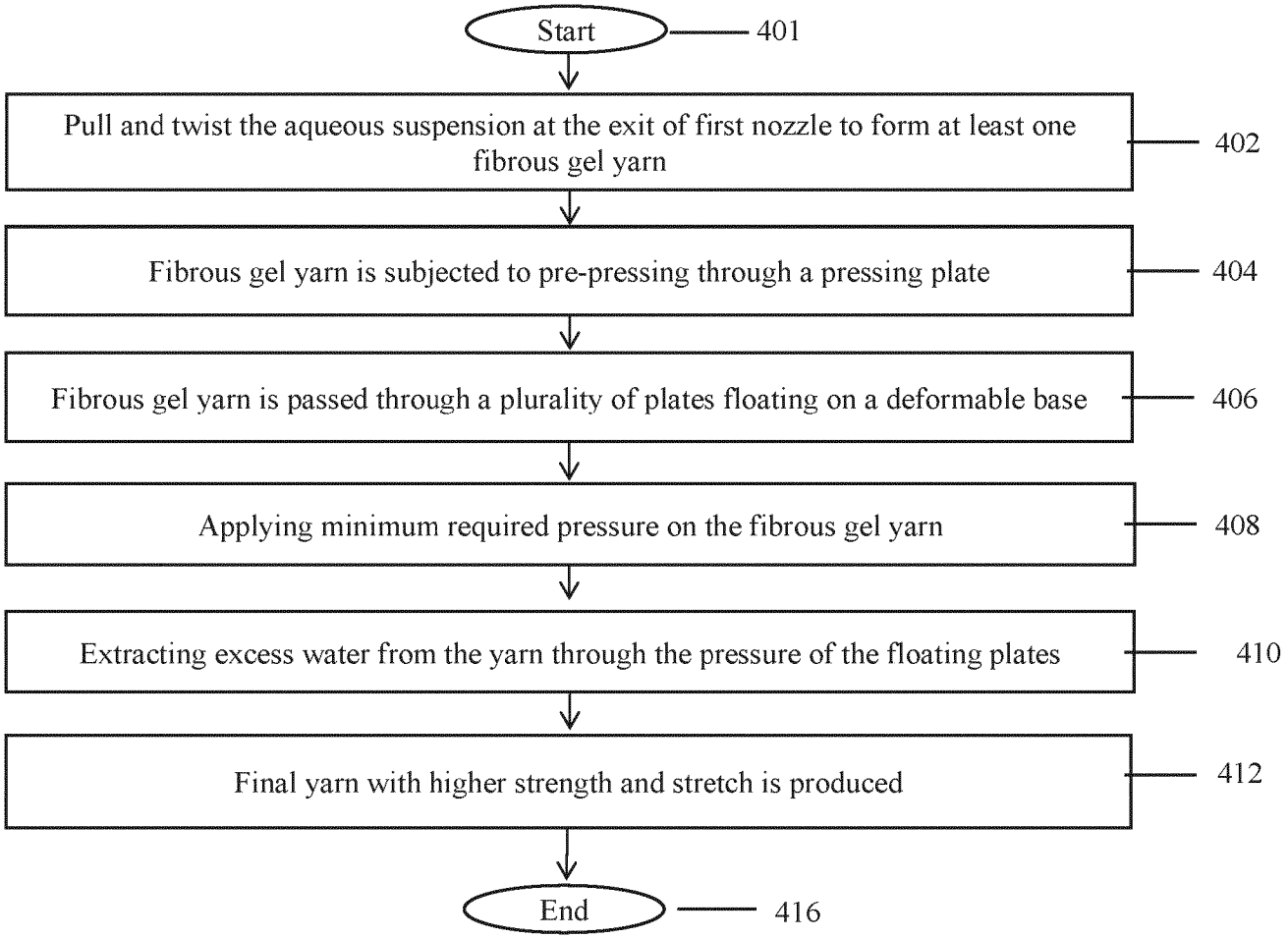
FIG. 4 illustrates a flow chart of various steps related to dewatering the fibrous yarn, according to various embodiments of the present invention.
Figure 5:
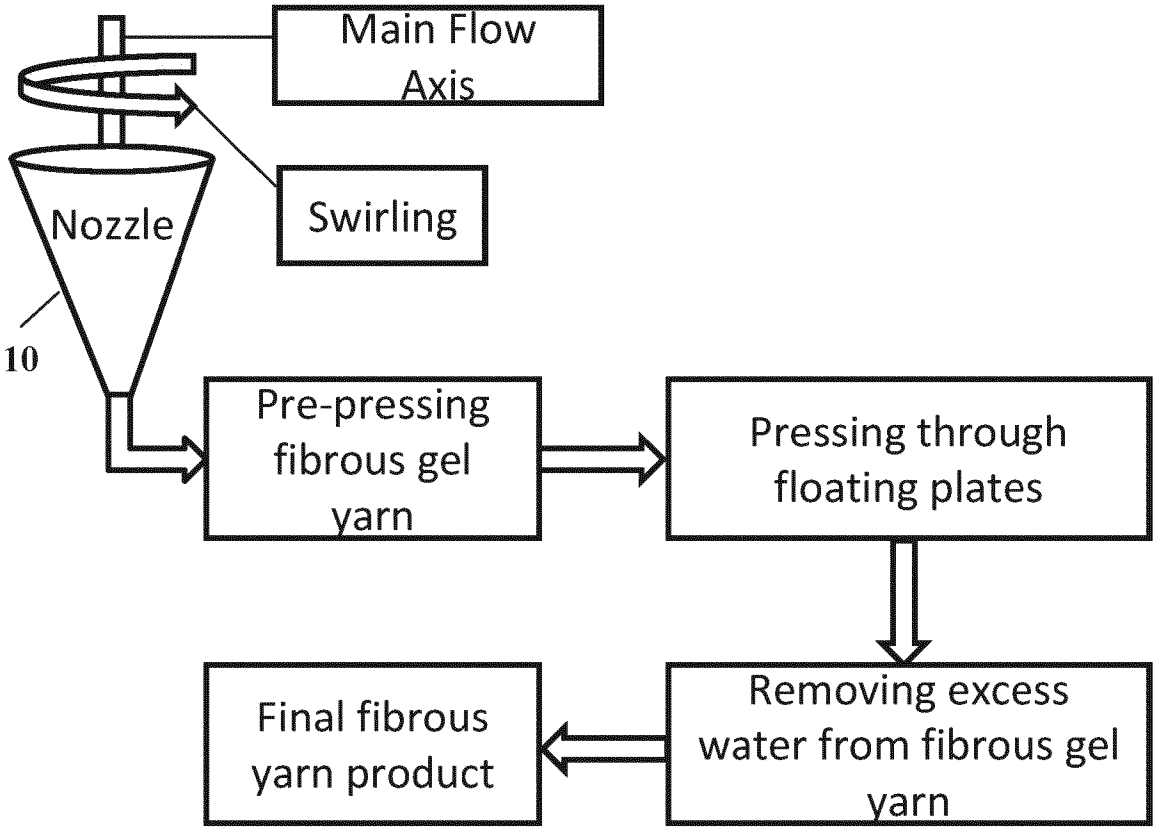
FIG. 5 illustrates a block diagram of the system for dewatering the fibrous yarn, according to various embodiments of the present invention.

FIG. 4 provides a flow chart depicting various steps related to dewatering the fibrous yarn, according to various embodiments of the present invention. Further, FIG. 5 provides a block diagram of the system for dewatering the fibrous yarn, according to various embodiments of the present invention. These two diagrams will now be explained in conjunction.

Figure 6:
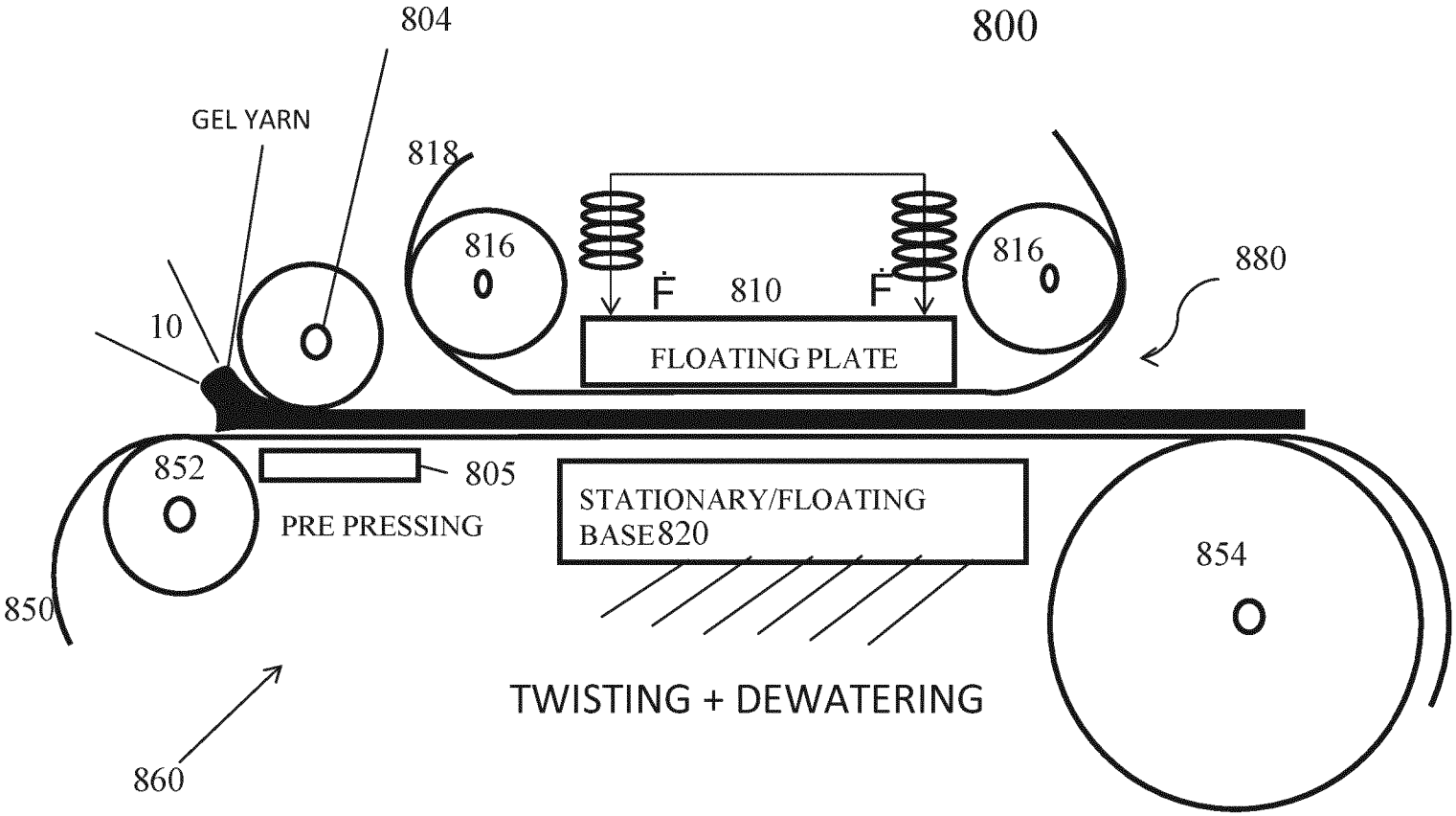
FIG. 6 illustrates a block diagram of the yarn producing apparatus, according to various embodiments of the present invention.
Figure 7:
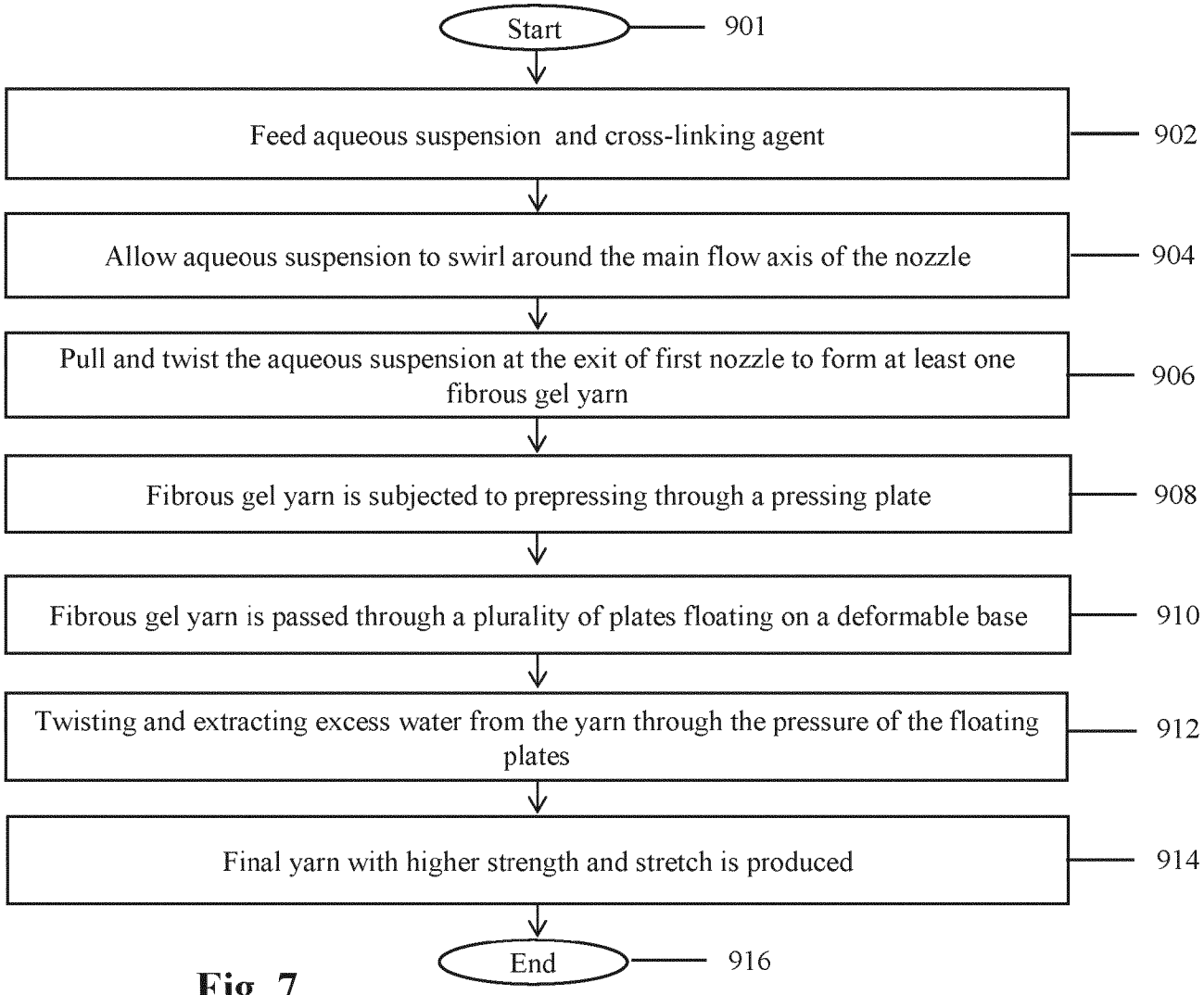
FIG. 7 illustrates a flow diagram explaining operation of yarn producing apparatus, according to various embodiments of the present invention.

The method of dewatering starts at step 401. At step 402, the aqueous suspension (in form of fibrous hydrogel) at the exit of first nozzle is pulled and twisted to form at least one fibrous gel yarn. The pulling and twisting is facilitated using dewatering apparatus (880) as shown in FIGS. 6-7, which is now explained.

The fibrous gel yarn at the exit of the nozzle, such as nozzle (10), is dropped on a permeable conveyer system (860) having a conveyer belt (850) [also referred as wire (850) or base wire (850)] operating on rollers (852) and (854). Due to the movement of the conveyer system (860), the fibrous gel yarn is pulled in the dewatering apparatus (880). The conveyer system is typically permeable to water and air, via holes in the material or otherwise. Speed difference between the hydrogel jet and the wire accelerates or decelerates the yarn making it thinner or thicker respectively.

Optionally, thereafter, the pulled fibrous gel yarn is subjected to pre-pressing through a pressing plate, such as pressing plate (805) and roller (804) assembled for that purpose, at step 404. Thereafter, at step 406, the fibrous gel yarn is passed through a plurality of plates, such as plates (810), in FIG. 8. The floating plates (810) are floating on a deformable base (820). In one embodiment, the floating plates (810) are floating over a stationary base (820). In some embodiments the plates themselves are deformable, i.e. the plates may be replaced by an air or fluid bag.

The floating plates (810) and the deformable/stationary base (820) are supported by a conveyer system having plurality of rollers (816) running a conveyer belt (818) [also referred as wire (818) or upper wire (818)]. This system allows pulling and twisting of the fibrous yarn in the dewatering apparatus (880).

The plurality of floating plates (810) applies suitable pressure as required for the dewatering of the fibrous gel yarn, at step 408. Further, the plurality of floating plates (810) is adapted to twist and dewater the fibrous gel yarn for dewatering at step 410. Twisting of the yarn during the dewatering is achieved by introducing an angle between the traveling direction of the upper and lower wires. This creates a sideways shear to the yarn and the yarn starts to rotate between the wires. Moreover, the floating plates (810) are adapted to maintain the uniform round shape of the yarn during the dewatering phase and give a good tensile strength to the final yarn product at step 412.

FIGS. 6 and 7 provide block diagram and flow chart respectively for the system of the entire yarn producing apparatus (800) as proposed by the present invention. The system includes an aqueous suspension having fibers and at least one rheology modifier, fed in the nozzle (10). The system further includes the dewatering apparatus (880). The nozzle (10) is adapted to arrange a swirling flow of the aqueous suspension. The system further includes a pressing mechanism having the conveyer system (860) with rollers (852), (854) and belt, which pulls the fibrous gel in the dewatering apparatus (880).

The dewatering apparatus (880) includes pre-pressing roller (804) and plate (805) which pre-presses the yarn to dehydrate it, and floating plates (810) supported on stationary/ floating base (820), which twists the yarn.

FIG. 7 specifically illustrates a flow diagram explaining operation of yarn producing apparatus. The aqueous suspension along with the crosslinking agent are fed from the nozzle (10). In one embodiment, they may be fed from the side of the nozzle, such as nozzle (10), at step 902. The nozzle (10) is adapted to swirl the flow of the aqueous suspension along the main flow axis of the nozzle, at step 904. Then, at the exit of the nozzle, the aqueous suspension pulled and twisted and merged with the annular flow of a crosslinking reagent, at step 906. Such pulling and twisting of the aqueous suspension increases the strength and stretch of the final yarn product.

Now, the dewatering process and pressing mechanism starts. The excess liquid removal starts at the very initial phase of the dewatering process. In this phase, the yarn is present inside a cross linked hydrogel coat and most fibers are still relatively free in the water suspension. The yarn hydrogel coat is initially very thin and too violent pressing may rupture the whole yarn. The thickness and strength of the gel coat increases with time due to the diffusion that drives the cross linking process. Hence, to avoid the breakage of the fibrous gel yarn the water removal must be fast but not too violent.

Accordingly, the present invention discloses a pressing mechanism having a pre-pressing system and a special floating pressing system configured between the wires to prevent too violent water removal from the fibrous gel yarn.

The pressing mechanism as proposed in at least some embodiments of the present invention includes a pre-pressing system, where the hydrogel yarn is passed between a base belt (850) and the belt (818), at step 908. Where the base belt (850) and the upper belt (818) are arranged with no angle difference and the base wire (850) presses the fibrous gel yarn to a flat strip of fibrous yarn. With this base wire (850) pressing, the cross linking agent penetrates through the whole gel yarn quickly and the resulting fiber strip becomes adequately strong for twisting and water removal.

In the twisting and water removal phase the yarn must be able to adapt its round shape freely. For this, the gap between the pressing wires or belts must change according to the shape of the fibrous yarn. This may be achieved by letting the upper wire (818) supporting structure to be freely floating and this is performed by loading the upper wire (818) with floating pate (810) supported by springs of weights or by pressurized air cushions, at step 910. The floating plates (810) remove the excess water of the yarn and simultaneously twist the yarn, at step 912. During the twisting, yarn surface replicates the wire or belt surface structure. If the wire and the drying section surfaces are smoother then a smoother yarn product having higher strength and stretch is produced, at step 914.

In addition, and with reference to the aforementioned embodiments of the invention, the aqueous suspension having fibers and at least one rheology modifier is allowed to swirl around the main flow axis of the nozzle. Such swirling of the aqueous suspension around the main flow axis of the nozzle is completed by feeding the aqueous suspension asymmetrically from the side of the nozzle. Further, a cross-linking agent is merged with the flow of the aqueous suspension at the exit of the nozzle. Further, the aqueous suspension at the exit of the nozzle is pulled and twisted and then subjected to pressing and the dewatering.

Moist yarn obtained from the nozzle initially includes water typically from 30 to 99.5% w/w. In the dewatering step, the yarn may be dried to desired water content.

The invention provides several advantages. The manufacturing method is very simple and effective, and the equipment needed is simple and relatively cheap. The yarn is produced directly from the fiber suspension; it is not necessary to manufacture first paper.

The rheology of the fiber suspension may be adjusted using rheology modifiers to the viscosity and thixotropy range where the fiber suspension may be pumped through the nozzle without clogging it, but simultaneously to provide a moist yarn typically in gel form, which has sufficient strength to maintain its form during the drying step. Thus, the rheology modifier gives shear thinning nature and strength to the yarn; in the case alginate is used a dispersion agent is typically also needed and the treatment of the moist yarn with a salt solution is used to provide sufficient strength. The selection of the inner diameter of the outlet of the nozzle as smaller than or equal to the maximum length weighed fiber length of the fibers causes the fibers to orientate in the direction of the yarn, which provides the final product flexibility and strength.

The water released after drying may be recovered by condensing and recycled in the method, for example by using a closed system, and thus practically no wastewater is formed. Also, the amount of water needed in the process is very limited, particularly in the embodiment where the fiber suspension is provided in the form of foam.

The product is completely biodegradable if the starting materials used are natural materials.

The need of cotton may be reduced with the method and products of the present invention, where the fibers originate at least partly from more ecological plant material, such as wood and recycled paper.

Particularly, long fiber pulp, suitably manufactured from Nordic pine, may be used in the method to provide a yarn having the thickness of less than 0.1mm and very good strength properties.

While the invention has been described with respect to specific examples presented in the figures, including modes of carrying out the invention, those skilled in the art will appreciate that there are numerous variations and permutations of the above described embodiments that fall within the spirit and scope of the invention. It should be understood that the invention is not limited in its application to the details of construction and arrangements of the components set forth herein. Variations and modifications of the foregoing are within the scope of the present invention.

Accordingly, many variations of these embodiments are envisaged within the scope of the present invention.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to explain the principles of the present invention and its practical application, and to thereby enable others skilled in the art to utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the present invention.

The invention claimed is:

1. A method for manufacturing a fibrous yarn, the method comprising:

making an aqueous suspension having fibers originating from a plant based raw material source and at least one added rheology modifier;

directing said aqueous suspension through at least one nozzle to form at least one fibrous yarn;

merging the aqueous suspension at the exit of the nozzle with at least one annular flow comprising at least one cross linking reagent and an annular flow comprising at least one cross linking agent, wherein the aqueous suspension is accommodated in an inner flow channel, the cross linking reagent is accommodated in an outermost annular flow channel, and the cross linking agent is accommodated in an annular flow channel sandwiched between the innermost flow channel and the outermost annular flow channel; and subjecting said at least one fibrous yarn to dewatering, wherein the aqueous suspension inside the at least one nozzle is swirled around a main flow axis of said nozzle.

2. The method as claimed in claim 1, comprising the at least one fibrous yarn being pulled and twisted simultaneously while the aqueous suspension flows through at least one nozzle to form at least one fibrous yarn.

3. The method as claimed in claim 1, comprising pressing the at least one fibrous yarn mechanically from at least two opposite sides by a plurality of plates floating on a deformable base.

4. The method as claimed in claim 1, comprising adding a cross linking agent to said aqueous suspension at least before exiting the aqueous suspension from at least one nozzle, or at least after exiting the aqueous suspension from at least one nozzle.

5. The method as claimed in claim 1, wherein the aqueous suspension is allowed to swirl around the main flow axis of the at least one nozzle by selecting at least one of:

by feeding the aqueous suspension to the at least one nozzle asymmetrically from a side of said nozzle;

by creating, rotating and accelerating a flow of the aqueous suspension, where all the fibers of the suspension are aligned with said flow by rotating around the main flow axis;

by creating a swirling flow by using a plurality of grooved flow channels; and by creating a swirling flow by using a plurality of bend flow channels.

6. The method as claimed in claim 1, further comprising merging the aqueous suspension of the nozzle with at least one annular flow comprising at least one cross linking reagent.

7. The method as claimed in claim 6, wherein the at least one annular flow comprising the at least one cross linking reagent combines a plurality of fibrous yarns through a plurality of annular flow channels by using a plurality of small nozzles directed radially inside the at least one annular flow of the at least one cross linking reagent.

8. The method as claimed in claim 7, wherein the plurality of fibrous yarns are combined through coanda effect.

9. The method as claimed in claim 7, wherein the plurality of annular flow channels comprises: an innermost flow channel containing the aqueous suspension and the rheology modifier; a next annular flow channel containing the cross linking agent; and an outermost annular flow channel containing the cross linking reagent.

* * * * *